US005600988A

United States Patent [19]

Abbey, III et al.

[11] Patent Number: 5,600,988

[45] Date of Patent: Feb. 11, 1997

[54] MILL TOOLING CHANGEOVER SYSTEMS

[75] Inventors: Nelson D. Abbey, III, Monclova; Richard L. Dreier, Northwood, both of Ohio

[73] Assignee: Abbey Etna Machine Company, Perrysburg, Ohio

[21] Appl. No.: 387,445

[22] Filed: Feb. 13, 1995

[51] Int. Cl.[6] ..... B21B 31/08

[52] U.S. Cl. ..... 72/239; 72/176

[58] Field of Search ..... 72/129, 176, 178, 72/181, 238, 239

[56] References Cited

U.S. PATENT DOCUMENTS

| | | | |
|---|---|---|---|
| 2,120,316 | 6/1938 | Stone . | |
| 2,601,812 | 7/1952 | Honen . | |
| 3,323,341 | 6/1967 | Chang . | |
| 3,472,053 | 10/1969 | Chang . | |
| 3,475,939 | 11/1969 | Bier | 72/239 |
| 3,583,195 | 6/1971 | Sherwood | 72/239 |
| 3,665,746 | 5/1972 | Eibe | 72/239 |
| 3,748,719 | 7/1973 | Fuller et al. . | |
| 3,880,648 | 4/1974 | Nishiyori et al. | 72/239 |
| 4,435,970 | 3/1984 | Sekiya | 72/239 |
| 4,587,698 | 5/1986 | Bonner et al. . | |
| 4,724,695 | 2/1988 | Stoehr . | |
| 5,016,806 | 5/1991 | Yapp et al. . | |
| 5,095,728 | 3/1992 | Poloni | 72/239 |
| 5,107,695 | 4/1992 | Vandenbroucke | 72/176 |
| 5,148,960 | 9/1992 | Abbey, III et al. . | |
| 5,192,013 | 3/1993 | Abbey, III et al. . | |

FOREIGN PATENT DOCUMENTS

| | | | |
|---|---|---|---|
| 189803 | 8/1986 | Japan | 72/239 |
| 036322 | 8/1990 | Japan | 72/239 |
| 0649196 | 11/1981 | U.S.S.R. . | |

*Primary Examiner*—W. Donald Bray
*Attorney, Agent, or Firm*—Donald R. Fraser

[57] ABSTRACT

An automated system for exchanging components of a continuous seam-welded tube mill to change from production of one tubular product to another. The components to be changed are mounted upon subbase units adapted to be removably affixed to a fixed mill base. Alternate sets of changeable mill units mounted on duplicate subbase sections are provided for off line tooling change and setup. Changeover modules are automatically conveyed from a tooling storage area to the mill base for automatic changeover. Push-pull units are incorporated in the changeover modules to shift the subbase sections from the mill base to the changeover module and the previously retooled duplicate subbase sections from the changeover modules into operative position on the mill bases.

21 Claims, 5 Drawing Sheets

MILL TOOLING CHANGEOVER SYSTEMS

BACKGROUND OF THE INVENTION

1. Field of the Invention

The present invention relates generally to a mill for the production of continuous seam-welded tubes of pipes and, more particularly, to an automated system for changing such a mill from the production of tubes of one size or shape of tube to the production of tubes of another and different size or shape.

2. Description of the Prior Art

In accordance with a well known process for producing seam-welded tubes, a continuous strip or skelp is advanced through forming section of apparatus which includes a series of forming rolls and formed into a tubular form having an open, longitudinally extending seam formed by the abutting edges of strip or skelp being formed. The tubular form is then advanced through a welding section wherein the abutting edges are urged together and joined by a suitable welding process. The welding process may cause the formation of an unwanted bead which may next be removed by a suitable scarfing procedure. The welded tube is then, after passing through a cooling zone, advanced through a series of sizing and squaring rollers whereby the tube is formed to the final configuration and size. The advancing continuous tube is then severed by means of a travelling cutting unit into individual sections of a predetermined length.

The tube forming apparatus is designed to be capable of conversion to the production of various sizes and cross-sectional configurations of tube. As will be readily manifest, such apparatus constitutes massive precision machines representing a considerable investment of capital. Heretofore, it was often necessary to shut down a production of tubes of one size or shape to convert the apparatus to produce tubes of a different size or shape. More specifically, the line was shut down and the various components were individually removed and replaced by components required for production of the next product. The replacement components then had to be properly set and adjusted on the line before production could resume. The entire changeover routine could consume a considerable period of time, as much as five or six hours or more. Obviously, the changeover time involves a considerable expenditure in time and capital, and an extensive loss of production. As a result, it becomes necessary to maintain unduly large inventories of finished products, contrary to the current trend toward maintaining minimum inventory and frequently changing from the production of one product to another.

SUMMARY OF THE INVENTION

In accordance with the present invention the aforementioned deficiencies of the prior art devices are overcome by producing a tube mill utilizing an automated procedure for exchanging components of the mill sections to change from production of tubes of one size or shape to the production of tubes of another and different size or shape. The stand assemblies of the mill which are to be changed during the changeover procedure are mounted on removable sub-base sections adapted to be carried on a fixed mill base. The stand assemblies and associated subbase may be removed from the fixed mill base and transferred to a remote wash station and thence to an off-line changeover location adjacent a secondary storage cart.

An automatically operated pressure fluid activated push-pull module pulls the front stand onto the secondary storage cart for temporary removal to a temporary storage area. Simultaneously, another secondary cart carrying empty roll racks is positioned along the roll stand assembly adjacent the exposed forming rolls and associated spacers. The push-pull module pushes the roll rack toward forming rolls and roll manipulators push the rolls and spacers onto the empty roll rack. The secondary storage cart carrying the removed forming rolls is moved to another position away from the stand assembly and eventually to a remote forming roll storage area. Another secondary storage cart with roll racks carrying the changeover rolls is indexed adjacent the roll stand assembly and the push-pull module pushes the roll rack toward the roll stand allowing the roll manipulators to be actuated to engage and pull the new forming rolls onto the roll stand assembly. The secondary cart with the emptied roll racks is moved toward the secondary forming roll storage cart exposing the newly positioned forming rolls.

The secondary front stand storage cart is indexed adjacent the roll stand assembly with the newly positioned forming rolls and the front stands are pushed into engagement with the roll stands and secured in place preparatory to being returned to the mill section for operation.

It will be appreciated that the advantages of a continuous tube mill incorporating the present invention includes less down time of the mill even for relatively short production runs.

Since the changeover procedure is carried out automatically, the dependency of the operator is nearly eliminated resulting in predictable and efficient changeover times.

The continuous tube mill incorporating the concepts of the present invention enables preventative maintenance and cleaning of the forming roll assemblies to be easily accomplished without disruption of production.

Since each of the primary sections of the mill are effectively independent of the other, each section may be of differing sophistication without adversely affecting the overall mill operation.

BRIEF DESCRIPTION OF THE DRAWINGS

In the drawings, wherein like reference numerals are employed to designate like parts throughout the same.

DESCRIPTION OF THE PREFERRED EMBODIMENT

Figure 1:
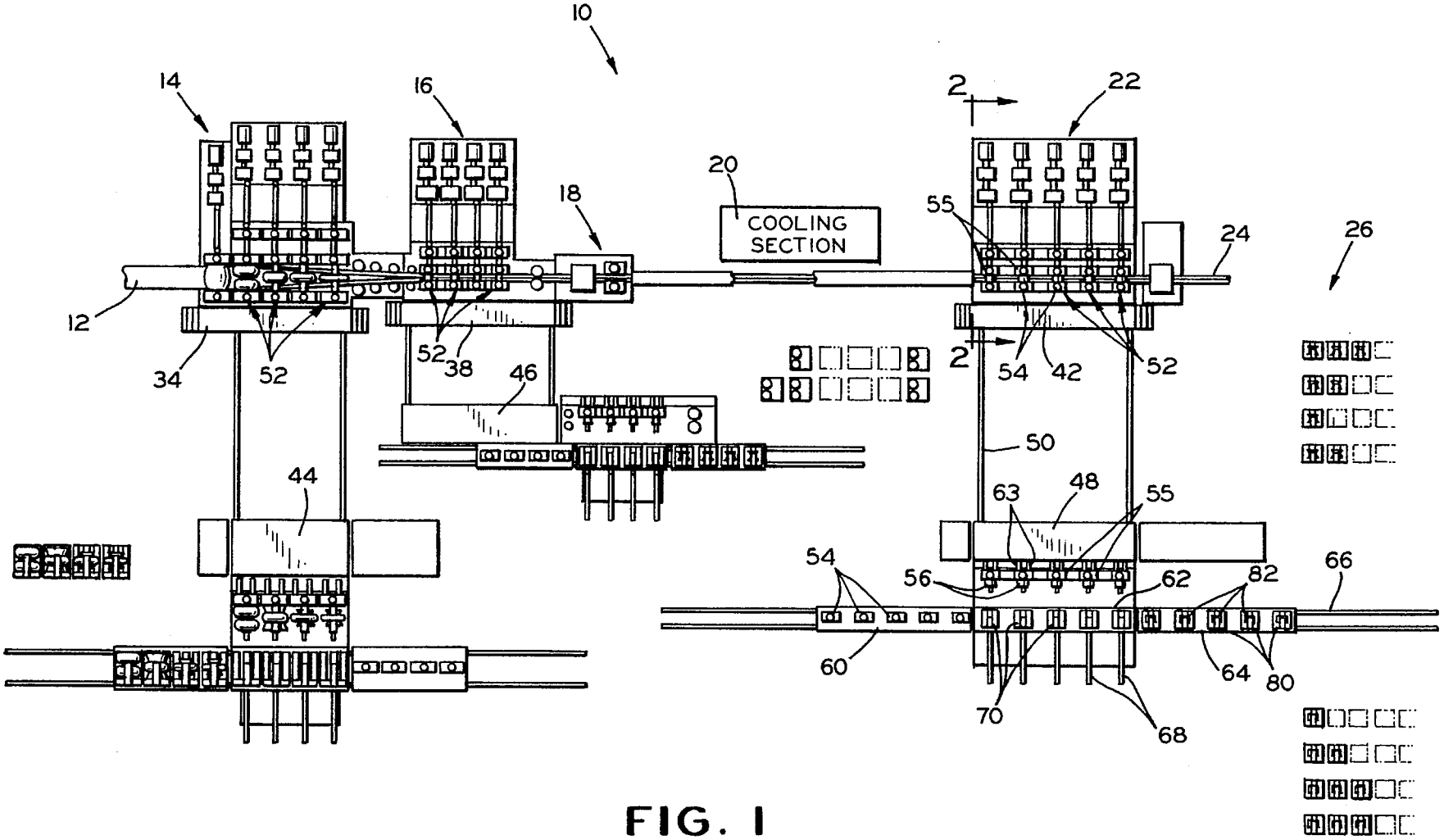
FIG. 1 is a top plan view of a portion of a tube mill embodying the invention.

With reference to the drawings, and particularly to FIG. 1, there is shown generally at 10 an automated tube mill changeover system embodying the invention. In such tube mills a metal strip or skelp 12 is continuously withdrawn from a supply (not shown) and advanced successively through a forming section 14, a fin section 16, a welding section 18, a cooling section 20, and a sizing and squaring section 22 to produce a continuous seam-welded metal tube or pipe 24. Thereafter, the finished tube or pipe 24 is separated into individual segments of predetermined lengths in a cutoff section 26. Such sections, per se, are conventional in the art as disclosed, for example, in U.S. Pat. Nos. 5,148,960 and 5,192,013, to which reference may be had for a further description.

The forming section 14 more particularly comprises a series of forming stands mounting opposed driven breakdown rolls, and cluster units of forming rolls. The fin station 16 includes fin stands, an intermediate side closer unit, and a seam guide unit. The welding section 18 typically includes a welder, a weld bead scarfing unit, an associated chip winder, and a working and traction unit.

The cooling section 20 typically includes an open type cooling trough along which pairs of upper and lower Vee-type rolls to convey the tube. Manifolds above the pass line are adapted to spray-coolant onto the tube 24 to cool the seam following welding. The sizing and squaring section 22 includes a series of alternating side closer units and sizing stands through which the tube 24 passes to be formed to the proper size and configuration. Following exit from the final sizing stand, the tube 24 passes through a straightening unit prior to being severed into individual sections of desired length in cutoff section 26.

Figure 2:
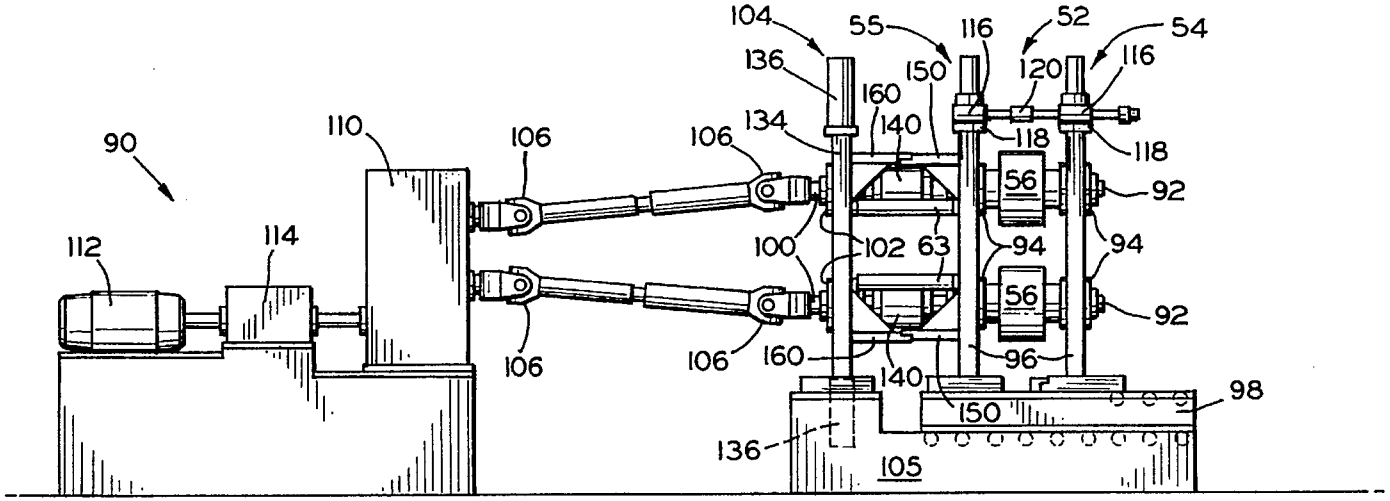
FIG. 2 is an end view of a stand assembly of the sizing and squaring section of the mill illustrated in FIG. 1 showing the stand assembly in normal running position.
Figure 3:
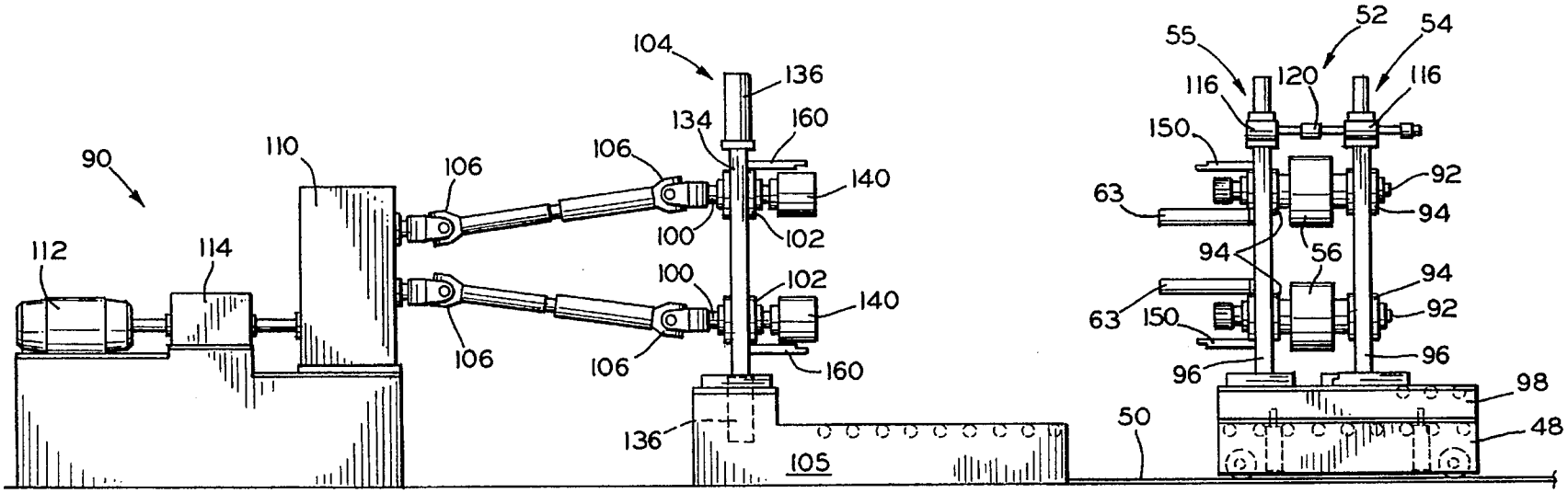
FIG. 3 is an end view of a stand assembly illustrated in FIG. 2 showing a stand assembly moved from the drive motor assembly.
Figure 4:
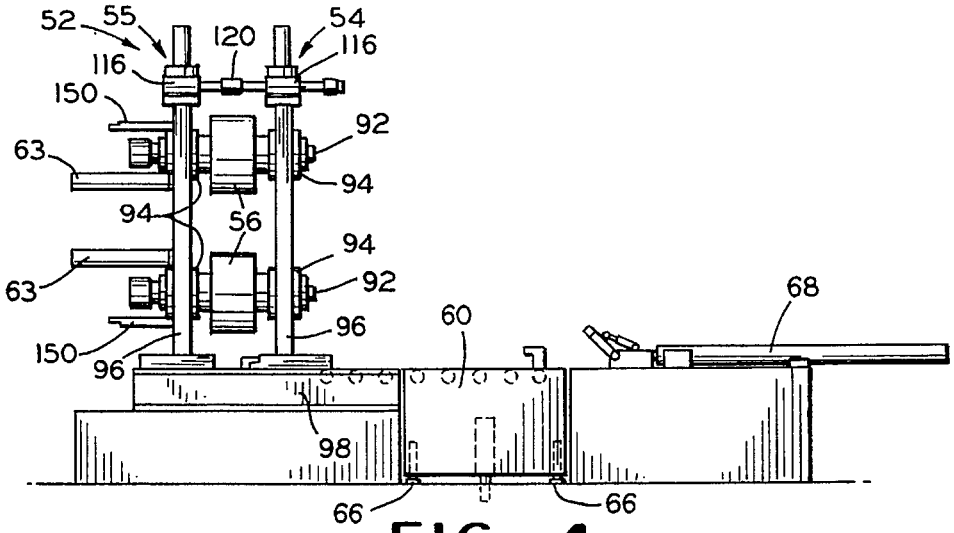
FIG. 4 is an end view of the stand assembly illustrated in FIG. 2 moved into an off-line changeover position.
Figure 5:
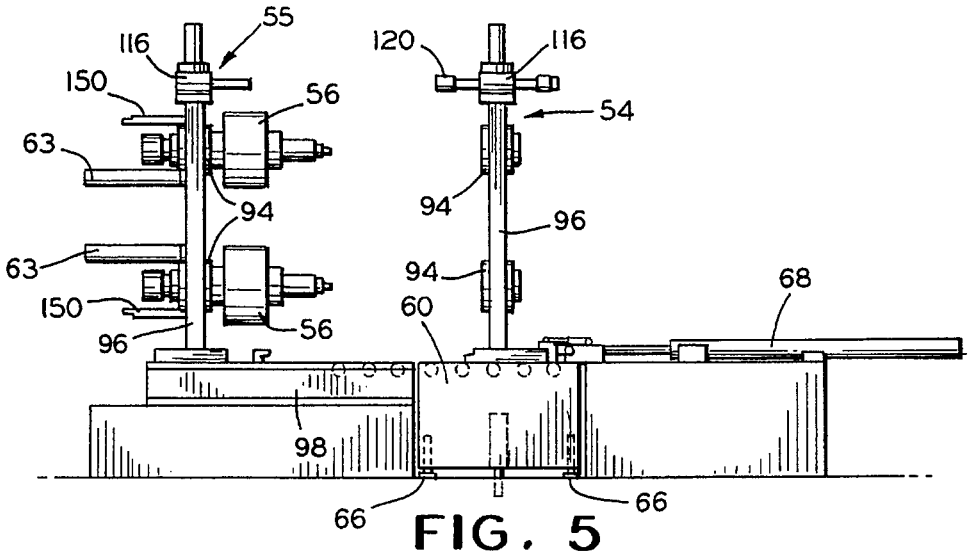
FIG. 5 is an end view of the stand assembly illustrated in FIG. 4 showing the front stand pulled onto an empty stand storage cart.

As will be readily understood, the units through which the skelp 12 passes within the forming, welding and sizing sections 14, 18 and 22, respectively, to be formed into the tube 24 utilize various types of forming elements or rollers which are limited to production of one particular diameter or type of tube. The tube is merely conveyed through the cooling section 20 by Vee-type rollers, so that the cooling section may accommodate tubes of different sizes. Whenever the mill is converted from production of tubing of one diameter or type to another, it is necessary to change the tooling of each of the individual units in at least the forming section 14, the welding section 18 and the sizing section 22. Heretofore, each of these units has been affixed to the permanent mill base. Thus, in order to convert from production of one product size to another it was necessary to shut the mill down while the units were dismantled, reassembled and adjusted on line. Each such changeover resulted in the loss of several hours production time. In accordance with the present invention the units are affixed to subbases, adapted to be removably affixed to a permanent mill base as illustrated in FIGS. 2 and 3, for example. Automatic manipulating apparatus for removing and replacing forming rolls off from and onto the stand assemblies is provided. A transfer cart system including roll rack units is further provided for the transfer of forming rolls to and from selected storage areas remote from the stand assemblies. The actual changeover time during which production is lost is substantially reduced to a matter of minutes, generally on the order of five to fifteen minutes.

The forming section 14, the welding section 18, and sizing and squaring section 22 include subbase frames upon which the various units of the forming mill are mounted. Each of the subbase frames is adapted to be removably affixed to a fixed mill base positioned along the production line.

Catwalks 34, 38 and 42 are disposed adjacent the forming, welding, and sizing sections 14, 18, and 22, respectively. The catwalks 34, 38 and 42 are mounted on rails which extend away from the sections and generally parallel to the centerline of the mill permitting the catwalks to be moved aside during periods of mill changeover.

A primary transfer cart 44, 46, and 48 is provided for each of the forming section 14, the welding section 18, and sizing and squaring section 22, respectively.

The transfer carts 44, 46 and 48 for each of the above mentioned mill sections serve a common function with substantially identical components. To simplify the description and facilitate the understanding of the invention, the transfer cart associated with only a single mill section will be described in detail.

The transfer cart 48 associated with the sizing and squaring section 22 is deemed to be exemplary and will be described in some detail. The transfer cart 48 includes guide rails 50 which typically extend normal to the centerline of the tube mill and are effective to transport and guide the transfer cart for transporting a stand assembly 52 of the sizing and squaring section 22 temporarily to a remote washing position. Typically, the stand assemblies 52 include a front stand 54 and a rear stand 55.

After the washing of the assembly 52 is accomplished, the primary transfer cart 48 is positioned adjacent to a secondary transfer cart assembly which includes three individual carts 60, 62, and 64 and associated supporting guide rails 66 adapted to guide the carts 60, 62, and 64 along a path generally normal to the guide rails 50.

A plurality of pressure fluid operated manipulating motors 68 is disposed on the opposite side of carts 60, 62, and 64. Each of the manipulating motors 68 is operative to span the cart 60 for attachment to a front stand 54 of the stand assembly 52. The front stand 54, being previously loosened or unattached from the stand assembly 52, is then pulled onto the cart 60 to expose the forming rolls 56 to be replaced. The cart 60 with the front stands 54 is moved to a position on the guide rails 66 away from the primary transfer cart 48 as illustrated, for example, in FIG. 1.

Next, the secondary cart 62 having empty roll storage racks 70 is moved into position and the empty storage racks are indexed with the rear stands 55 such that the forming rolls 56 and associated spacers may be received thereon, as illustrated, for example, in FIG. 1. More specifically, roll manipulators 58 illustrated in FIGS. 7 and 9 mounted on the rear stands 55 are employed to move the rolls 56 on to the empty roll racks 70. The roll manipulators 58 are typically mounted in pairs on the rear stands 55 and are designed to extend and contract to push a roll 56 off of the stand assembly onto an empty roll rack 70 or, as will be appreciated hereinafter, to pull a replacement roll on to the stand assembly. The roll manipulator 58 also is capable of rotating about the longitudinal axis thereof to move a contact arm 59 into and out of engagement with a slot or groove 59*a* formed in the spacer of the forming rolls 56. The structure of the roll manipulators 58 is illustrated in FIG. 9.

The roll manipulators 58 include a main frame portion containing pivotally mounted contact arms 59 which are caused to selectively pivot into and out of engagement with slots formed in the spacer elements of the forming rolls 56. The pivotal movement is effected by pressure fluid operated motors 61. The main frame of the manipulators 58 is mounted to reciprocate horizontally by a pair of pressure fluid actuated motors 63.

Figure 6:
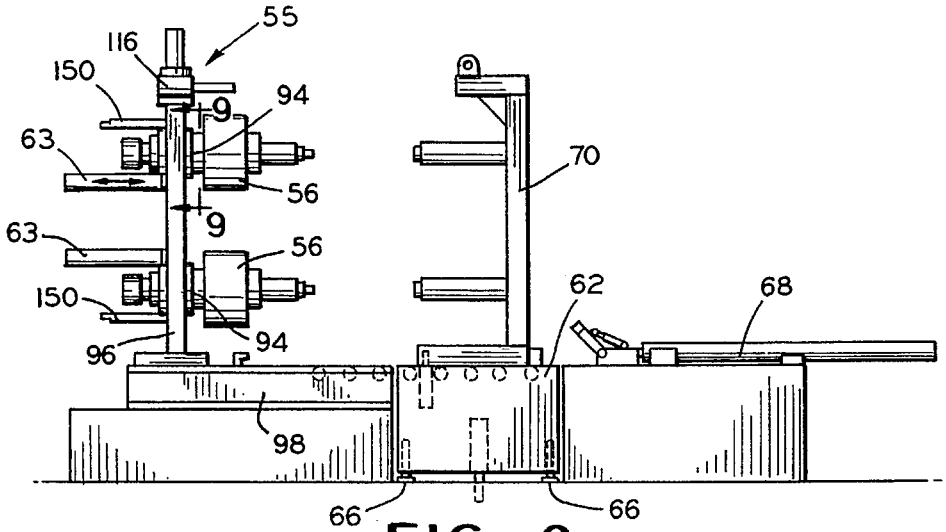
FIG. 6 is an end view of the stand assembly illustrated in FIG. 5 showing a cart in position with an empty roll rack in position ready to receive the forming rolls and associated spacers being changed.
Figure 7:
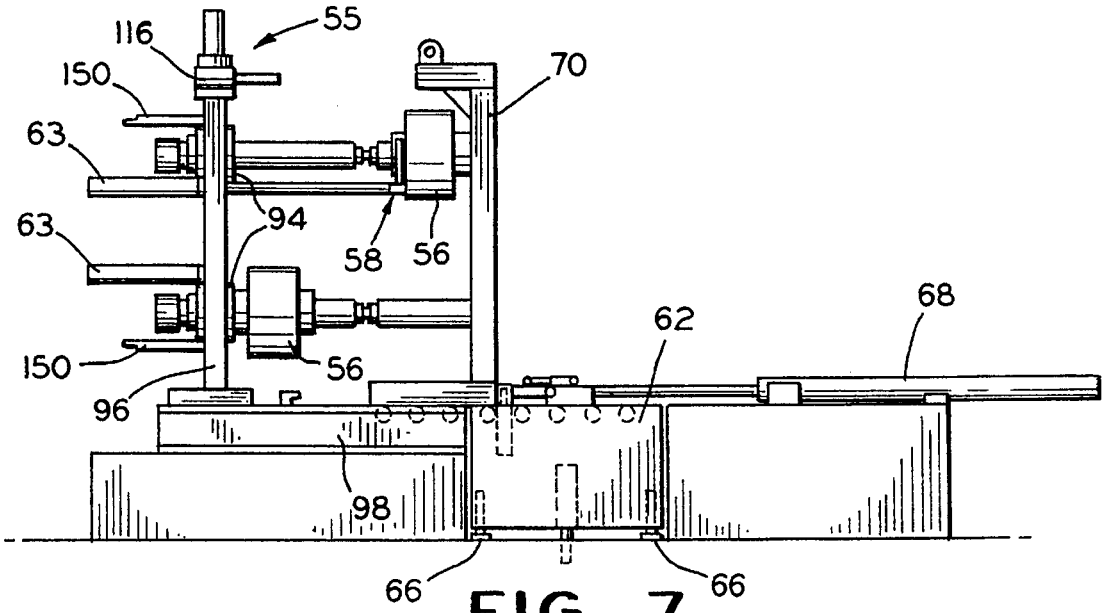
FIG. 7 is an end view of the stand assembly illustrated in FIG. 6 showing the empty roll rack being pushed into roll receiving position and the roll manipulators commencing the push of the forming rolls and associated spacers onto the empty roll rack of FIG. 6.
Figure 8:
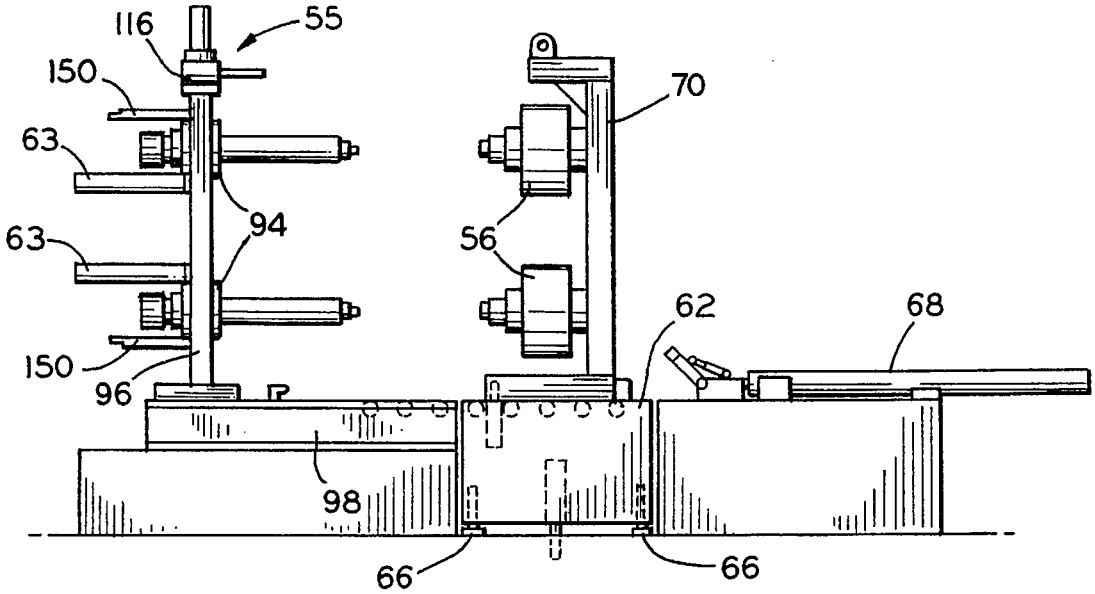
FIG. 8 is an end view of the stand assembly illustrated in FIG. 7 after the roll rack has received the rolls and spacers to be replaced have been moved away and another roll rack containing the new forming rolls and spacers in position awaiting the placement on the awaiting stand assembly.
Figure 9:
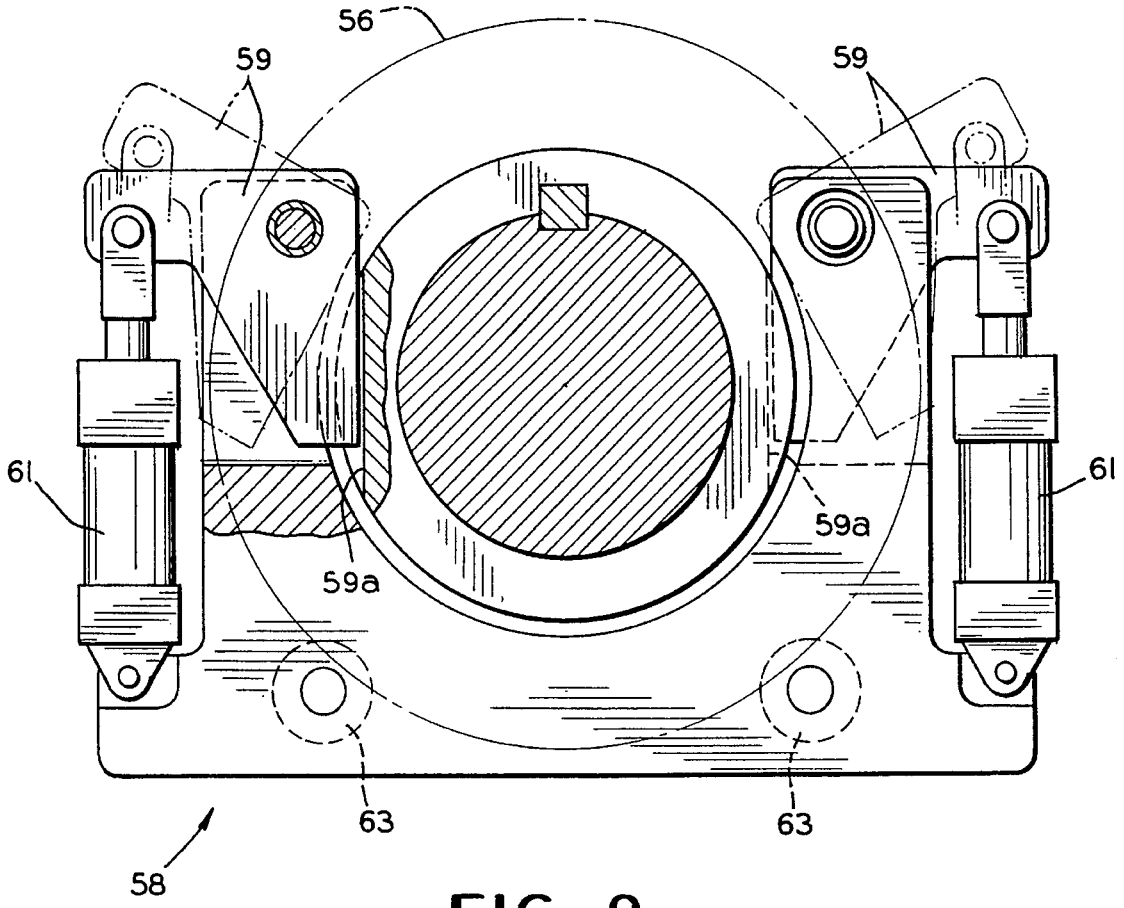
FIG. 9 is a sectional view along line 9—9 of FIG. 6 showing the mechanical movement of the roll manipulating apparatus for removal and replacement of the forming rolls.

As will be noted by viewing FIGS. 6, 7, and 9, the operation for removing a roll 56 includes the steps of energizing the motors 61 to cause the contact arms 59 to pivot into engagement with the slots in the roll 56, and then the motors 63 are energized to push the roll 56 onto the adjacent roll rack 70.

When the roll 56 is properly positioned on the roll rack 70, the motors 61 are caused to pivot the contact arms 59 from the full lined or latched position to the dotted lined or unlatched position and the main frame of the manipulator 58 is retracted by the motors 63.

Manifestly, the operation is reversed when it is desired to remove a roll 56 from an awaiting roll rack 70.

Upon completion of the positioning of the forming rolls 56 to be replaced on the roll racks 70, the cart 62 is moved on the guide rails 66 allowing the secondary cart 64 with roll racks 80 containing replacement rolls 82 to move into position adjacent the rear stands 55 awaiting the replacement rolls. At this point, the manipulating motors 68 are actuated to push the roll racks 80 toward the roll stands and the roll manipulators 58 are extended and the contact arms 59 are indexed into the grooves within the spacers of the rolls 82 and are energized to pull the replacement rolls 82 off of the racks 80 onto the rear stands 55. Upon completion, the cart 62 with emptied roll racks 80 is then moved on the rails 66 toward the storage area, allowing the cart 60 to index with the rear stands 55 such that the front stands 54 are properly positioned to enable the manipulating motors 68 to be actuated to push the front stands 54 into engagement with the rear stands 55 and secured thereto. Finally, the manipulating motors 68 are retracted and the primary cart 48 is caused to be moved, on the supporting rails 50, to the awaiting drive mechanism.

The changeover system described hereinbefore is specifically referenced to the sizes and squaring section 22 of the tape mill. However, it will be readily appreciated that the same parameters are employed in the forming section 14, and the fin and the welding sections 16, 18 to achieve the changeover of components used in the production of tubes of one size or shape to the production of tubes of another and different size or shape.

Another common feature of the apparatus resides in the structure of the stand assemblies. Again, reference will be made to the stand assemblies 52 which form components of the sizing and squaring section 22. During the initial changeover phase of the tube mill operation, the rolls or other tube forming elements will be of different diameters or shapes for forming tubes of different sizes. Consequently, the operative position or spacing of the rolls will be different for each set of rolls. Provision for effecting such spacing is thus more for moving the rolls to a selected vertical positions on the upright supporting stanchions. As will be seen in FIG. 2, the driven mill components of the sizing and squaring section 22 are coupled to a drive system 90 by means of separable self-aligning couplings. The stand assemblies 52 incorporate the driven forming rolls 56 carried on shafts 92. The shafts 92 are suitably journalled by bearing units 94 in spaced apart upright standions 96 affixed to a subbase 98. The rolls 56, or other forming tools of each stand 52 are driven by power takeoff shafts 100 journalled in bearing blocks 102 suitably mounted in an adjacent or third stand 104. The stand 104 is fixedly mounted upon the mill base 105.

The power takeoff shafts 100 are coupled through universal joints 106 to output shafts 108 and a gearbox 110 mounted on suitable base member. The gear box 110 is coupled to a drive motor 112 through a shift box 114.

The rolls 56 will be of different diameters for forming tubing of different sizes. Consequently, in operative position the spacing between the supporting shafts 92 will be different for each of the different forming element configurations.

Provision is made for moving the bearing units 94 to selected vertical positions with the upright stanchions 96. The stanchions 96 typically include spaced pairs of legs between which the bearing units 94 are mounted for sliding up and down vertical movement. In certain instances, the bottommost bearing unit 94 may be seated against its base, for example, so that the associated shaft 92 would remain at a constant elevation and only the uppermost bearing unit would move.

The upper bearing units 94 are operably connected to screw jack units 116 mounted upon plates 118 atop the legs of the stanchions 96. The screw jack units 116 are interconnected for simultaneous operating by an operating shaft 120.

Bearing blocks 102 are mounted within the adjacent drive stand 104 for vertical sliding movement within spaced stanchions 134. A hydraulic cylinder unit 136 is connected to the upper bearing unit 102 and a similar hydraulic cylinder 136 is connected to the lower bearing unit 102. The hydraulic cylinder units 136 are coupled to a suitably controlled source of pressure fluid to actuate selective vertical movement and the upper and lower bearing units 102.

By operation of the driven unit with the subbase 98 in operative position on the mill base unit 106 and the operating shaft 120 coupled to the screw jack units 116 the screw jack units 116 will be operated simultaneously to raise or lower the upper bearing units 94 of the stand 52. In order to maintain axial alignment of the uppermost shafts 92 and 100, upper and lower hydraulic cylinders 136 are provided for vertically moving the bearing blocks 102 and the associated shafts 100. Thus, it can be seen that axial alignment of the uppermost bearing units 94, the associated shafts 92 and the uppermost shafts 100 can be maintained by properly simultaneously energizing the power to the operating shaft 120 and the hydraulic cylinder 136.

In order to provide power to the rolls 56 the drive stand 132 is provided with conventional self-aligning separable couplings identified generally at 140. These couplings and their operation are clearly illustrated and described in a copending application Ser. No. 08/198,479 filed Feb. 18, 1994, and now U.S. Pat. No. 5,461,896.

Initiation of the changeover sequence commences by discontinuing the feeding of the strip or skelp 12 into the mill and clearing the previously manufactured tube from the mill. All mill operator guards are removed or retracted. The guards are typically provided with an interlock system so that the mill will not operate should the guards be moved from operative protective position, and the changeover procedure could not proceed.

Next, the stand assembly 52 is moved away from the drive system 90. The hydraulic cylinders 136 are typically actuated to cause the bearing blocks 102 and the associated shafts 100 to be moved to the maximum opened position. In such position, the associated self-aligning couplings 140 are in proper position to be moved into position alignment with the newly introduced stand assembly containing the changeover rolls.

The positive alignment apparatus includes shelf-like extensions 150 which are connected to and extend laterally outwardly from the upper and lower bearing units 94 of the innermost stanchions 96 of stand assembly 52. Reinforcing gussets may be employed to provide the necessary mechanical strength to the extensions 150.

Cooperating with the extensions 150 are shelf-like extensions 160 which extend laterally from the upper and lower bearing units 102 of the stand 104 and outwardly toward the extensions 150. As in the extensions 150, gussets may be employed to provide the necessary mechanical strength to the extensions 160.

In operation when a replacement stand assembly 52 is positioned preparatory to coupling of the separable couplings 140, the spacing of the bearing blocks 94 has been effected at a remote location. The stand assembly 52 is positioned on the mill base 106 and is moved toward an operating position. Just prior to a completely coupled position, at least the upper hydraulic cylinder 136 is actuated and causes the bearing block 102 to be lowered until the under surface of the shelf-like extension 160 contacts the upper surface of the shelf-like extension 150 causing the cooperating sections of the self-aligning couplings 140 to be aligned sufficiently to effect the desired operative connection between the rear stand 52 and the third stand 104. Thus, the extensions 150 and 160 cooperate to facilitate the mill changeover and assure that the separated couplings 140 will be in proper alignment for recoupling automatically as the replacement subbase unit 98 is moved into operative position.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A continuous tube mill apparatus adapted for automatic changeover production of a first product to production of a second product of a different size or shape, the tube mill comprising;

a tube forming section including a plurality stand assemblies adapted to receive forming roll sets for producing a selected size and shape of tubing;

automatic manipulating apparatus for removing and replacing forming roll sets on the stand assemblies;

a storage section for storing forming roll sets for the production of tubing of a selected size and shape; and transfer system including a primary transfer cart means for transporting the stand assemblies to a position remote from the mill and secondary transfer cart means for transporting the roll set for producing a selected size and shape of tubing to said storage section and for sequentially transporting another roll set to the stand assemblies for producing another size and shape of tubing.

2. A continuous tube mill as claimed in claim 1 wherein the tube mill includes a mill base.

3. A continuous tube mill as claimed in claim 2 wherein the stand assemblies are mounted on said mill base.

4. A continuous tube mill as claimed in claim 2 wherein the stand assemblies are separable from the mill base.

5. A continuous tube mill as claimed in claim 4 wherein the stand assemblies include removable front stands.

6. A continuous tube mill as claimed in claim 1 wherein said automatic manipulating apparatus includes means for selective pushing and pulling action.

7. A continuous tube mill as claimed in claim 6 wherein said automatic manipulating apparatus includes pressure fluid operated motors.

8. A continuous tube mill as claimed in claim 1 wherein said storage section is remote from said tube forming section.

9. A continuous tube mill as claimed in claim 8 wherein the secondary transfer cart means includes carts selectively movable between said tube forming section and said storage section and the stand assemblies transported by the primary transfer cart means.

10. A continuous tube mill as claimed in claim 5 wherein the secondary transfer cart means includes transfer cart means for transporting the front stand away from said stand assemblies.

11. A continuous tube mill as claimed in claim 1 including guide rails for guiding movement of the primary transfer cart means.

12. A continuous tube mill as claimed in claim 1 including guide rails for guiding movement of the secondary transfer cart means.

13. A continuous tube mill as claimed in claim 1 wherein the secondary transfer cart means is provided with rack assemblies for supporting forming rolls for use on the stand assemblies.

14. A continuous tube mill apparatus adapted for quick changeover from production of a first product to production of a second product of a different size or shape, the tube mill comprising:

a first subbase unit upon which forming units for forming the first product are mounted, said first subbase unit being removably mounted upon the mill base;

a changeover module positioned beside and spaced from said mill base;

a second duplicate subbase unit having forming units thereon for forming the second product movably positioned upon said changeover module; and means for removing the first subbase unit from said mill base to said changeover module and said second subbase unit from said changeover module into operative position on said mill base.

15. A continuous tube mill apparatus as claimed in claim 14 wherein said forming units include cooperating sets of rolls.

16. A continuous tube mill apparatus as claimed in claim 15 including means for driving said sets of rolls.

17. A continuous tube mill apparatus as claimed in claim 16 including means for selectively spacing the rolls of said sets.

18. A continuous tube mill apparatus as claimed in claim 17 wherein said means for selectively spacing the rolls of said sets includes a pressure fluid actuated motor means.

19. A continuous tube mill apparatus as claimed in claim 17 including means for predetermining the spacing between the rolls of said sets.

20. A continuous tube mill apparatus as claimed in claim 19 wherein the rolls of said sets are journalled in bearing blocks.

21. A continuous tube mill apparatus as claimed in claim 20 said means for predetermining the spacing includes cooperating sensing members affixed to said bearing blocks.

* * * * *